US005926934A

United States Patent [19]

Maeda et al.

[11] Patent Number: 5,926,934

[45] Date of Patent: Jul. 27, 1999

[54] METHOD FOR FORMING A ROW OF SLIDE FASTENER ELEMENTS

[75] Inventors: Yoshimichi Maeda; Toshio Aoki; Masafumi Mikkaichi; Kenichiro Iai, all of Toyama-ken, Japan

[73] Assignee: YKK Corporation, Tokyo, Japan

[21] Appl. No.: 09/038,417

[22] Filed: Mar. 11, 1998

Related U.S. Application Data

[62] Division of application No. 08/840,936, Apr. 25, 1997, Pat. No. 5,778,519, which is a division of application No. 08/518,309, Aug. 23, 1995, Pat. No. 5,671,510.

[30] Foreign Application Priority Data

Aug. 24, 1994 [JP] Japan ..... 6-199320

[51] Int. Cl.[6] ..... B21D 53/52

[52] U.S. Cl. ..... 29/408

[58] Field of Search ..... 29/408, 410, 33.2, 29/34 R, 769

[56] References Cited

U.S. PATENT DOCUMENTS

| | | | |
|---|---|---|---|
| 2,116,712 | 5/1938 | Prentice | 24/411 |
| 2,299,606 | 10/1942 | Wintritz | 29/410 |
| 2,628,400 | 2/1953 | Firing | 24/411 |
| 3,160,948 | 12/1964 | Firing | 83/921 |
| 5,495,655 | 3/1996 | Morioka | 29/410 |

FOREIGN PATENT DOCUMENTS

| | | | |
|---|---|---|---|
| 467126 | 8/1950 | Canada | 29/410 |
| 0028358 | 5/1981 | European Pat. Off. . | |
| 048969 | 7/1982 | European Pat. Off. . | |
| 0064764 | 11/1982 | European Pat. Off. . | |
| 320912 | 6/1989 | European Pat. Off. | 24/403 |
| 0580064 | 1/1994 | European Pat. Off. . | |
| 0630706 | 12/1994 | European Pat. Off. . | |
| 933384 | 7/1949 | Germany | 29/410 |
| 51529 | 11/1941 | Netherlands | 24/411 |

*Primary Examiner*—P. W. Echols
*Attorney, Agent, or Firm*—Hill & Simpson

[57] ABSTRACT

In manufacturing slide fasteners, especially fastener elements, an elongated wire of a generally Y-shape cross section with attaching legs shaped into a generally C form by rolling, is supplied intermittently at a predetermined pitch and is then cut into slices of element blanks having a predetermined thickness, and a protuberance is formed on the coupling head of each of the successive element blanks. Then, the generally C-shape attaching legs are calked from opposite sides to mount the fastener elements on a fastener tape and, at the same time, the generally right-angled cut edges of the attaching legs are shaped into a smooth arcuate profile as pressed by a calking surface of a calking punch.

6 Claims, 7 Drawing Sheets

METHOD FOR FORMING A ROW OF SLIDE FASTENER ELEMENTS

This is a division of application Ser. No. 08/840,936, filed Apr. 25, 1997 now U.S. Pat. No. 5,778,519, which is a division of application Ser. No. 08/518,309, filed Aug. 23, 1995 now U.S. Pat. No. 5,671,510.

BACKGROUND OF THE INVENTION

1. Field of the Invention

This invention relates to a row of slide fastener elements formed by cutting transversely a wire, which is rolled into a generally Y shape in cross section by multi-step rolling, and more particularly to a method and an apparatus for forming the slide fastener elements successively.

2. Description of the Related Art

A method for forming slide fastener elements of the above-described type is currently known. In the known method, an elongated wire having a circular cross section is rolled by a plurality of rollers into a generally Y shape in cross section, and then the rolled wire is cut by a cutting punch and a coacting cutting die into slices of element blanks, each slice having a predetermined thickness, whereupon the coupling head of each element blank is provided with a protuberance by a forming punch and a coacting forming die to finalize the individual element blank as fastener elements (hereinafter called "the wire fastener elements"). This conventional method is exemplified by EP-A0028358. The thus formed fastener elements are counted on a fastener tape successively in a predetermined pitch by calking the front and back attaching legs of each element on opposite sides of the tape by a calking punch.

According to the prior method, since the wire is rolled into a Y shape in cross section by rollers, any defective product can be eliminated to secure a very high rate of production. But since the individual fastener elements are obtained by cutting the wire into slices of a predetermined thickness by the cutting punch, the cut edges of each slice necessarily have burrs and are right-angled in cross section so that smooth beveled surfaces of the fastener elements cannot be achieved even by barrel polishing in a subsequent step.

Further, in the prior method, the opposite attaching legs of the individual element blank are bent toward each other so that each leg assumes a generally L-shape profile. When the opposite legs are calked against a fastener tape, the L-shape profile remains with the cut edges substantially rectangular in cross section after rolling, thus giving an uncomfortable touch. This drawback would be considerable in mounting the fastener elements successively on the fastener tape subsequently to the fastener element forming step. Consequently, as disclosed in EP-A0580064, it has been customary to bevel the peripheral portions of the coupling heads simultaneously with the forming of the fastener elements. In this case, it is possible to bevel the cut edges of the coupling heads, but it is impossible to bevel the L-shape profile and end edges of the leg.

In the case that the formed fastener elements are once discharged and are then mounted on the fastener tape, burrs of the formed fastener elements are removed by barrel polishing and, at the same time, their cut edges are beveled. But since the extent of beveling by this barrel polishing is limited to a minimum, a harsh touch still remains with the fastener elements mounted on the fastener tape so that an entirely smooth arcuate profile cannot be obtained.

SUMMARY OF THE INVENTION

It is therefore an object of this invention to provide a row of slide fastener elements, each of which has an entirely smooth arcuate surface with no angular ridges after wire fastener elements obtained by highly productive rolling are mounted on a fastener tape by calking. Another object of the invention is to provide a method and an apparatus for forming such fastener elements.

In order to accomplish the above object, according to a first aspect of the invention, there is provided a row of slide fastener elements which are obtained by supplying intermittently at a predetermined pitch a wire rolled into generally Y shape in cross section and by cutting the rolled wire transversely into slices of element blanks of a predetermined thickness, each slice of element blanks having a coupling head and a pair of attaching legs, forming a protuberance on the coupling head of each element blank to finalize the coupling head, and mounting each element blank successively on an intermittently supplied fastener tape at predetermined positions by calking the attaching leg thereof on front and back sides of the fastener tape to finalize the individual element blanks as the slide fastener elements. The slide fastener elements are characterized in that the legs of each slide fastener element has a substantially arcuate profile as formed during the rolling, and at least cut edges of the legs have smooth beveled surfaces as formed during the calking.

The fastener elements having the above-described structure can be obtained by a method for forming a row of slide fastener elements, comprising the following steps. a wire is rolled into a generally Y shape in cross section while the wire is intermittently supplied at a predetermined pitch. Subsequently, the rolled wire is cut transversely into slices of element blanks of a predetermined thickness, each slice of the element blanks having a coupling head and a pair of attaching legs. Then, a protuberance is formed on the coupling head of each element blank to finalize the coupling head, and the element blanks with the finalized coupling heads are mounted successively on an intermittently supplied fastener tape at predetermined positions by calking the attaching legs of each element blank on front and back sides of the fastener tape to finalize the individual element blanks as the slide fastener elements. At the same time, the legs of each slide fastener element are provided with a substantially arcuate profile during the rolling, and at least cut edges of the legs are provided with smooth beveled surfaces during the calking.

The method is carried out by an apparatus for forming a row of slide fastener elements comprising a rolling means, a cutting die, a protuberance-of-coupling-head forming die, a cutting punch, a protuberance-coupling-head forming punch, and a calking punch. The rolling means rolls a wire into a generally Y shape in cross section while the wire is intermittently supplied in a predetermined pitch. The cutting die has on a wire supplying path a through hole for insertion of the rolled wire and movable reciprocatingly in a direction of cutting the wire. The protuberance-of-coupling-head forming die is situated contiguously to a forward end of the reciprocating movement of the cutting die. The cutting punch is fixed to a frame and situated in frictional contact with an upper surface of the cutting die. The protuberance-of-coupling-head forming punch is situated above a protuberance forming station and vertically movable toward and away from the forming die. The calking punch calks the attaching legs of the individual element blanks, which are provided with the respective protuberances, successively on a fastener tape being supplied intermittently at a predetermined pitch. Further, the rolling means have rolling surfaces for providing the individual attaching leg with a generally C-shape profile, and the calking punch has calking surfaces for providing cut end edges of the individual attaching leg with smooth beveled surfaces.

For production, the wire of a desired cross section is rolled by multi-step rolling while it is supplied intermittently at a predetermined pitch. The rolled wire has a generally Y-shape cross section; specifically, each attaching leg has a generally C-shape arcuate profile. Regarding the profile of the individual fastener element immediately after cutting, the end of each leg has smooth arcuate surface unlike the conventional fastener element whose leg end portion is inwardly bent in a generally L shape with a ridgeline at the bend.

Upon completion of supply of the wire, a first ram advances to its front end stop position in which the wire projects by a predetermined length above the cutting die. Then the first ram starts moving backward to cut the projected portion of the wire by the cutting punch, and at the back end stop position of the first ram, the cut element blank is moved from the cutting die to the forming die. However, at this stage, each of the legs of the element blank is substantially rectangular in cross section, which yet is far from that of a smooth arcuate surface. At that time, the calking punch is stopped restricting the horizontal movement of the element blank by supporting the legs of the element blank from opposite sides. Then, at the back stop position of the first ram, the forming punch is lowered along with a pressure pad to form a protuberance on the coupling head.

Then, as the first ram starts moving forwardly, the calking punch operates to start calking the legs of the fastener element. During this calking, the outer cut edge of the individual leg is deformed so as to have a smooth arcuate surface as the leg is pressed gradually from its end to base by part of a calking surface of the calking punch, and the opposite legs of the individual fastener element are bent toward each other as the outer surfaces of the legs are pressed by the remaining part of the calking surface.

In the fastener element mounted on the fastener tape, at least the cut end edge of each leg is shaped into an entirely smooth curved profile. Accordingly, the resulting slide fastener not only has a comfortable touch but also has a low frictional resistance to movement of a slider so that smooth closing and opening operations of the slide fastener can be achieved.

DETAILED DESCRIPTION OF THE PREFERRED EMBODIMENT

A preferred embodiment of this invention will now be described in detail with reference to the accompanying drawings.

A slide fastener element forming method and apparatus of this invention comprises, as the most characteristic part, simultaneously with forming a wire rolled into a generally Y shape in cross section, shaping opposite attaching legs of a generally V-shape cross section into a generally C-shape profile having a smooth arcuate surface by rolling, and then beveling at least cut edges with angular ridges of the legs so as to have smooth arcuate surfaces while the fastener element is mounted on a fastener tape by calking the opposite legs by a calking punch having a predetermined calking surface after a protuberance is formed on the individual coupling head obtained by cutting the wire.

Figure 11:
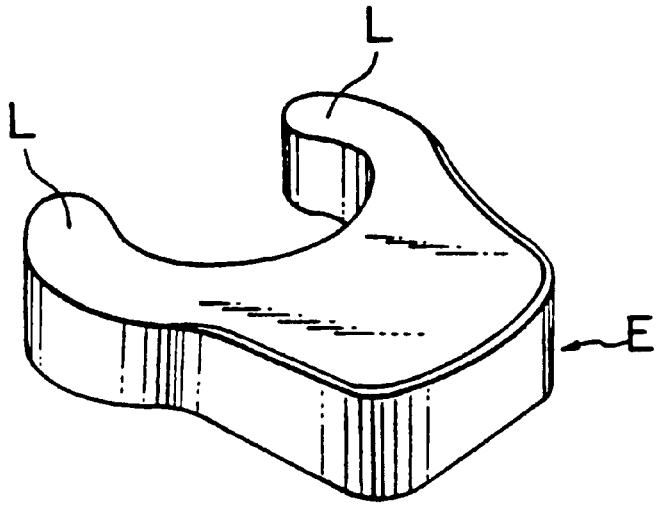
FIG. 11 is a perspective view showing the fastener element immediately after having been cut according to this invention.
Figure 12:
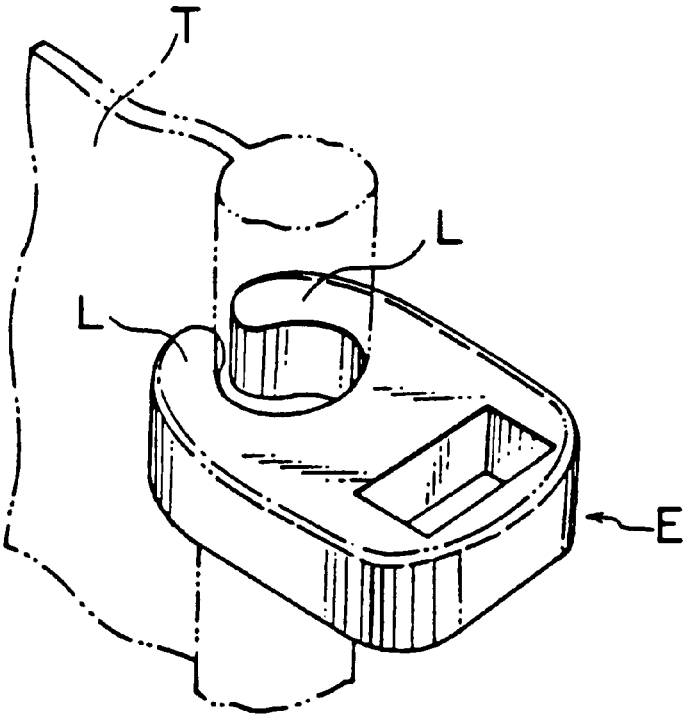
FIG. 12 is a perspective view showing the fastener element immediately after having been amounted on a fastener tape according to this invention.

FIG. 11 is a perspective view of an element blank E obtained from the wire W by the method and apparatus according to this invention, showing the shape of the element blank E after rolling and cutting. FIG. 12 is a perspective view showing the shape of the fastener element E after its opposite legs L have been calked on front and back sides of a fastener tape T. As is apparent from FIGS. 11 and 12, the rolled wire W having a generally Y-shape cross section is shaped in such a manner that the individual leg L has a generally C shape in cross section having an arcuate surface from its base to end unlike the conventional leg having a generally L-shape profile.

The wire W having a generally Y-shape cross section is supplied intermittently in a predetermined pitch to the apparatus equipped with a cutting punch and a protuberance-of-coupling-head forming punch. The apparatus used in this embodiment is identical with the ordinary construction disclosed in, for example, EP-A0048969 except for a calking punch 13. Therefore the following description concentrates on the calking punch 13 and its associated parts, referring to the remaining construction only briefly.

Figure 1:
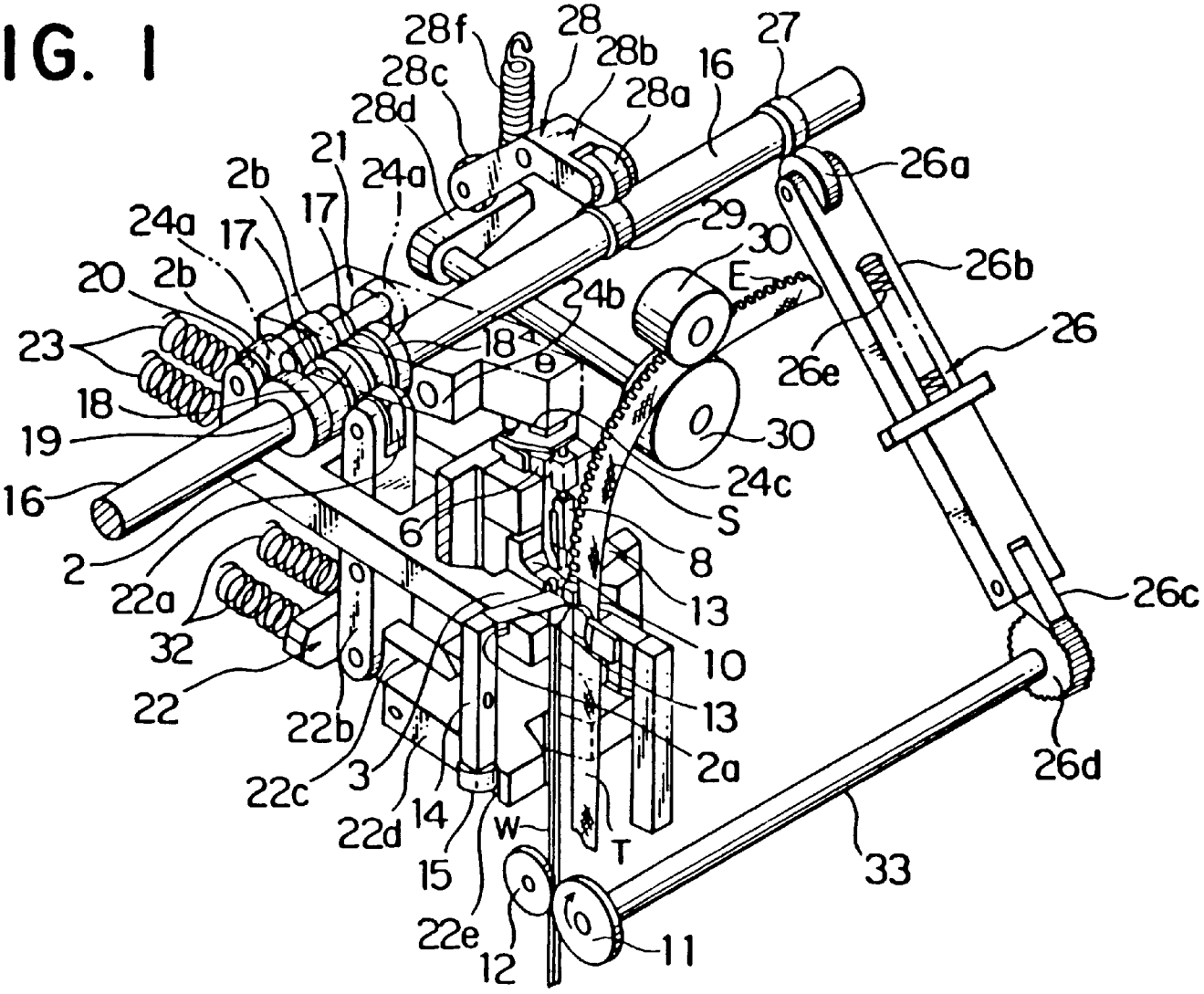
FIG. 1 is a fragmentary perspective view of a slide fastener element forming apparatus according to a typical embodiment of this invention.
Figure 2:
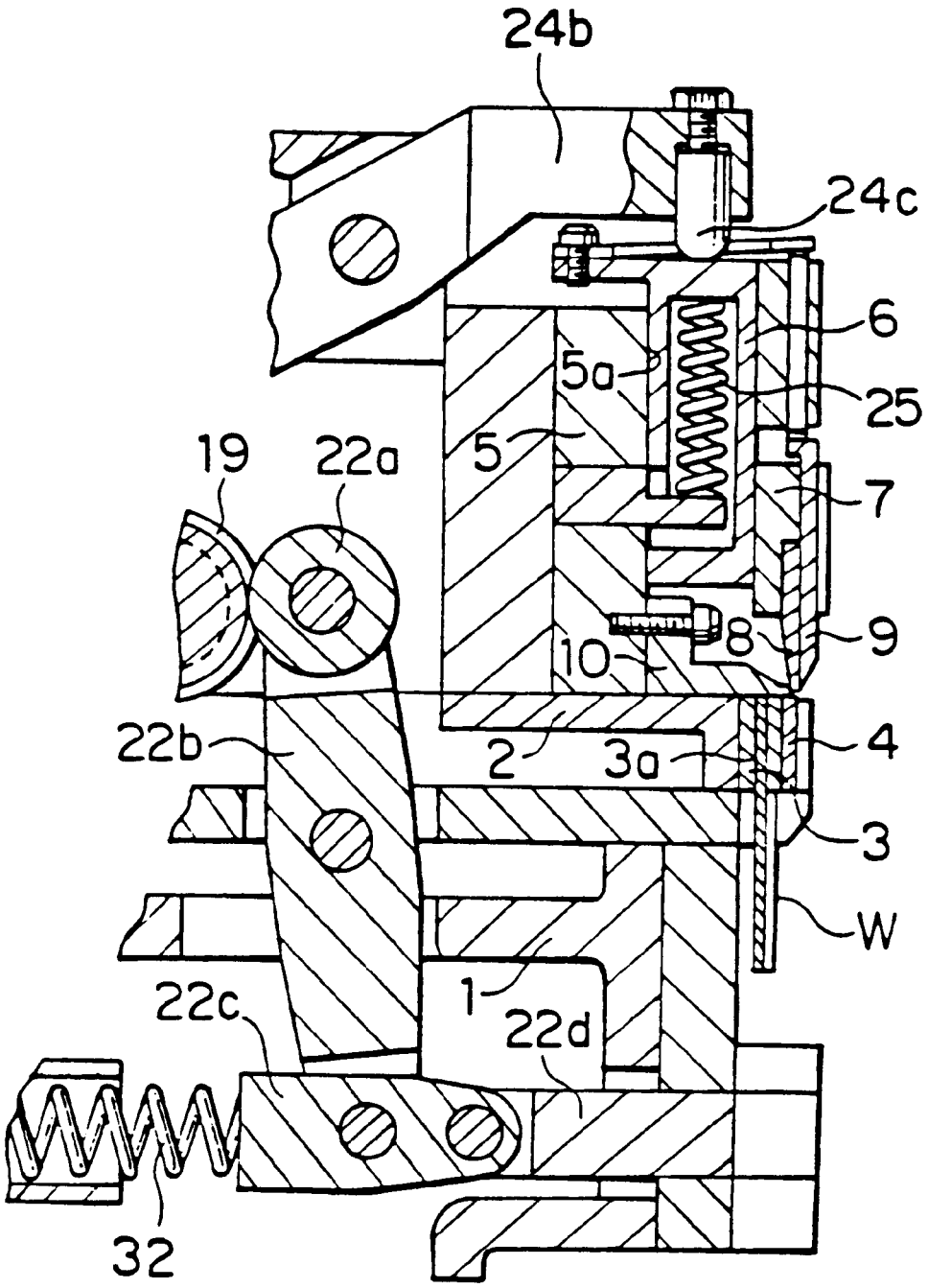
FIG. 2 is a vertical cross-sectional view of a fastener element forming section of the apparatus.

FIGS. 1 and 2 show the main structure of a slide fastener element forming apparatus according to this invention. In FIGS. 1 and 2, a first ram 2 is horizontally reciprocatingly movably mounted on a frame 1, and a cutting die 3 having a through hole 3*a* for insertion of a wire W having a Y-shape horizontal cross section is situated continuously to the front end of the first ram 2, next to which a protuberance-of-coupling-head forming die 4 is situated.

Above and in front of the first ram 2, a ram guide 5 is situated having a guide groove 5*a* in which a second rat 6 is vertically movable in timed relation with the horizontal reciprocating movement of the first ran 2. To the front surface of the second ram 6, a protuberance-of-coupling-head forming punch 8 and a pressure pad 9, which presses opposite legs of the element blank E during the forming of a protuberance, are attached. Further, to the lower end of the ram guide 5, a cutting punch 10 is fixed in frictional contact with the upper surface of the first ram 2. Below the through hole 3*a* of the cutting die 3, a feed roller 11 and a guide roller 12 are situated for upwardly supplying the wire W intermittently at a predetermined pitch corresponding to the thickness of the individual fastener element E.

On opposite sides of the forming punch 8, a pair of calking punches 13, which is a characteristic part of this invention, are slidably received in the respective hammer slide grooves 2*a* formed in the upper surface of the first ran 2. So the two calking punches 13 can move toward and away from each other In and along the hammer slide grooves 2*a* to calk the opposite legs L of the individual fastener element E against a fastener tape T, thus mounting the individual fastener element E on the fastener tape T. The calking punches 13, as shown in FIG. 1, are attached to the respective upper ends of actuating levers 14 substantially perpendicularly thereto, having at their respective lower ends cam followers 15. Each actuating lever 14 is pivoted at its central portion on the frame 1 and is hence angularly movable about the pivoted central portion so as to cross the first ran 2 at a predetermined angle, thus causing the coacting calking punches 13 to slide in the hammer slide grooves 2*a* toward and away from each other.

Figure 7:
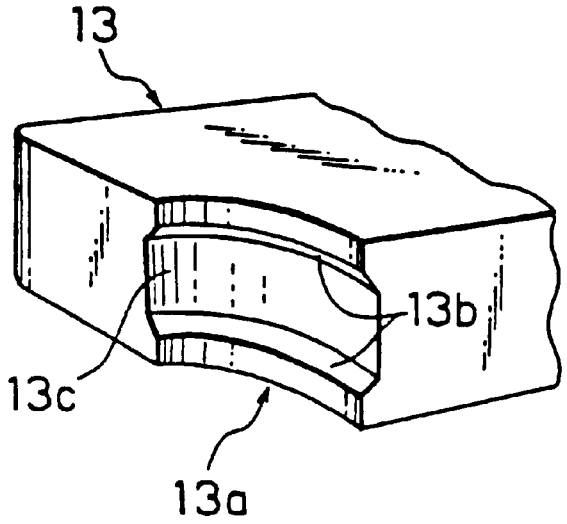
FIG. 7 is a fragmentary perspective view of an example of the calking surface of a calking punch.

FIGS. 3 through 6 show the manner in which opposite legs L of the fastener element E are deformed gradually from a generally Y shape into a generally C shape during calking. As shown in FIG. 7, the calking punch 13 has a calking surface 13*a* occupying substantially a half of the Talking end and including an arcuately curved groove 13*c* having upper and lower taper surfaces 13*b*.

The foregoing parts are actuated in predetermined timed relation with one another by a plurality of cams, i.e. a first ram drive cam 17 formed on a drive output shaft 16 situated at the back of the first ram 2, a forming punch actuation cam 18, a calking punch driving cam 19 and a non-illustrated wire supply cam, via cam followers 20, 21, 22 connected with the respective cams,17, 18, 19, as shown in FIG. 1.

The cam follower 20 of the first ram 2 is a roller 2*b* rotatably supported by the rear portion of the first ram 2 and resting on the first ram drive cam 17, and the first ram 2 is urged forwardly by a compression spring 23. As the cam 17 is rotated, the first ram 2 is stopped for a predetermined time at each of a predetermined front end position and a predetermined rear end position. The cam follower 21 of the forming punch 8 is composed of a roller 24*a* resting on the forming punch actuation cam 18, a lever 24*b* pivotally connected at its central portion to the frame and pivotally supporting at one end the roller 24*a*, a pin 24*c* attached to the other end of the lever 24*b* and contacting with the head of the second ram 6, and a compression spring 25 for returning the lever 24*b* to its original position. In the second ram 6, a non-illustrated compression spring normally urging the second ram 6 upwardly is counted, so that the lever 24*b* is pivotally moved by the cam 18 to lower the second ram 6 and returns to its original position under the bias of the compression spring.

The cam follower 22 of the calking punch 13 is, as shown in FIGS. 1 and 2, composed of a roller 22*a* resting on the calking punch drive cam 19, a downwardly extending lever 22*b* pivotally connected at its central portion to the frame 1 and pivotally supporting at one end the roller 22*a*, a link 22*c* pivotally connected at its central portion to the other end of the lever 22*b*, a third ram 22*d* pivotally supporting at its rear end a distal end of the link 22*c*, and the actuating lever 14 having on its upper portion the calking punch 13 and connected at its central portion. The front end of the third ram 22*d* has on each of opposite sides a cam surface 22*e* having an outwardly extending end, and a cam follower 15 supported by the lower end of the actuating lever 14 is in contact with the cam surface 22*e*. As the third ram 22*d* is retracted, the cam follower 15 contacting the cam surface 22*e* pivotally moves the actuating lever 14 to actuate the calking punch 13. The third ram 22*d* is returned to its original position by a compression spring 32. Therefore, by changing either the cam follower 15 or the cam surface 22*e*, it is possible to change the limit of movement of that calking punch 13.

A wire feed cam follower 26 is composed of a roller 26*a* resting on a wire feed cam 33, a slider 26*b* pivotally supporting at one end the roller 26*a*, a ratchet 26*c* attached to the other end of the slider 26*b*, and a ratchet wheel 26*d* to be rotated intermittently in a predetermined angular pitch in one way by the ratchet 26*c*. The ratchet wheel 26*d* is connected with a wire feed roller 11 by a transmission shaft 27 so that the wire W is intermittently supplied by the wire feed roller 11. The slider 26*b* is returned to its original position by a compression spring 26*e*. Downstream of the wire feed roller 11 and the guide roller 12 along the wire W, a number of rollers for rolling the wire W are arranged.

Figure 8:
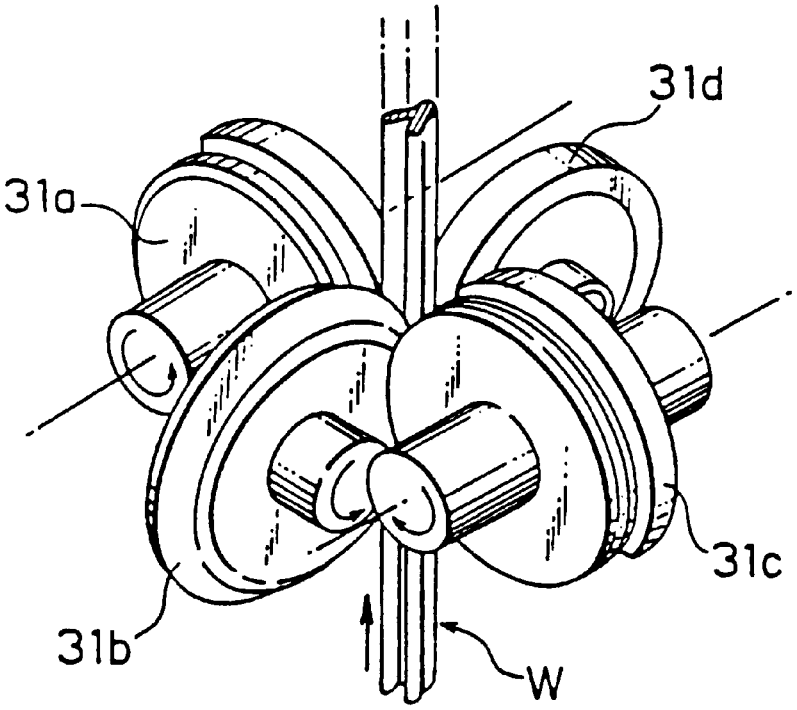
FIG. 8 is a perspective view showing the manner in which a wire is rolled by rollers.
Figure 9:
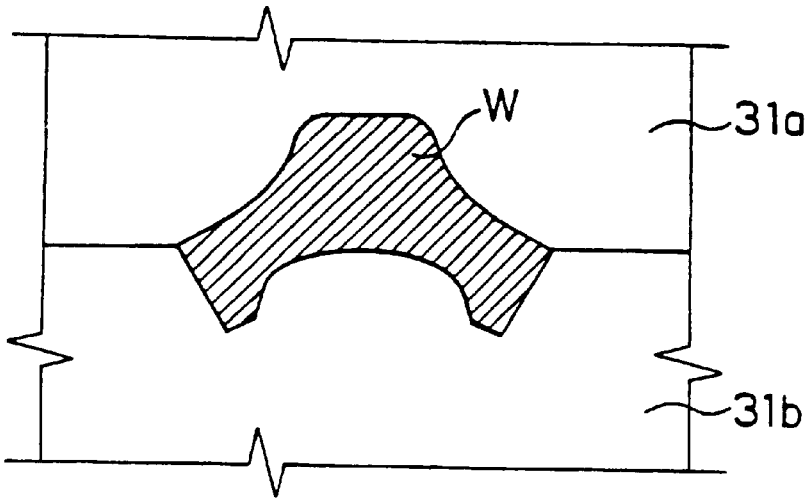
FIG. 9 is a horizontal cross-sectional view showing an initial stage of rolling of the wire.
Figure 10:
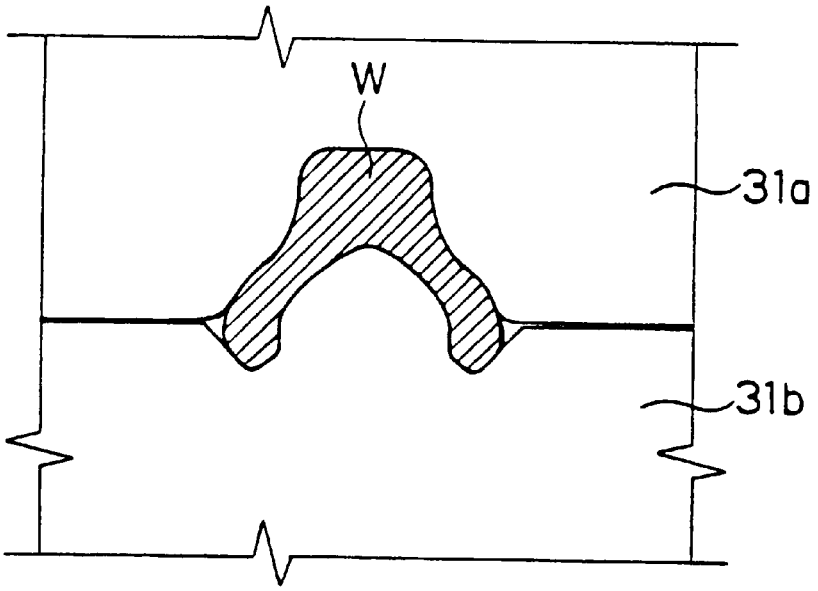
FIG. 10 is a horizontal cross-sectional view showing a final stage of rolling of the wire.

FIG. 8 shows an example of rolling mill 31 composed of four rollers 31*a*–31*d* respectively having forming surfaces facing one another to jointly define a space of a predetermined shape for insertion of the wire W. The rollers 31*a*–31*d* are rotated synchronously to compress the circumferential surface of the wire W to roll the wire W into a predetermined cross-sectional shape. The rolling mill 31 should by no means be limited to be composed of four rollers 31*a*–31*d* and may be composed of two rollers 31*a*, 31*b* respectively having unique forming surfaces, as shown in FIGS. 9 and 10. The rolling mill 31 is a multi-step structure; a wire W having a circular cross section is passed through a first-step rolling mill 31 so as to be deformed into a shape shown in FIG. 9 and is then passed through a number of steps of different rolling mills 31 so as to be finally deformed from an entirely smooth, generally Y-shape cross section, particularly the attaching leg L, into a generally C-shape arcuate profile, as shown in FIG. 10.

On the other hand, a fastener stringer feed cam follower 28, as shown in FIG. 1, is composed of a roller 28*a* resting on a fastener stringer feed cam 29, a first lever 28*b* pivotally connected at its central portion to the frame 1 not shown here and pivotally supporting at one end the roller 28*a* and at the other end the roller 28*c*, and a second lever 28*d* pivotally movable downwardly by the roller 28*c* and normally urged upwardly by a tension spring 28*f*. On the base end of the second lever 28*d*, a pair of stringer feed rollers 30 are supported via a one-way clutch (not shown) for intermittent rotation in one way to feed a fastener stringer.

In the foregoing apparatus, various parts are operated in predetermined timed relation with one another to form the individual fastener elements according to the-method of this invention. FIG. 11 shows the shape of the element blank E after rolling and cutting. FIG. 12 shows the shape of the fastener element E after its opposite legs L have been calked on front and back sides of a fastener tape T.

As mentioned above, a wire W of a generally Y-shape cross section, which is rolled in such a manner that the profile of the attaching leg L has a smooth arcuate surface, is fed intermittently at a predetermined pitch until the first ram 2 reaches its front stop position, namely, until the wire W projects above from the cutting die 4 by a predetermined length. In the first half of this step, the previous fastener element E has already been mounted on a fastener tape T to form a fastener stringer S, and immediately after the opposite calking punches 13 are retracted from the opposite legs L, the fastener stringer S is started to be pulled upwardly. After the coupling head of the fastener element E is removed from the forming die 4 situated contiguously to the front end of the cutting die 3, the first ram 2 is retracted. Therefore, the fastener elements E mounted on the fastener tape T are free from being caught by the forming die 4 that is retracted by the first ram 2.

Then, as the first ram 2 is retracted, the wire W is cut by the cutting punch 10. FIG. 11 shows the profile of the element blank E.

As is apparent from FIG. 11, regarding the profile of the individual fastener element immediately after cutting, the end of each leg has smooth arcuate surface unlike the conventional fastener element whose leg end portion is inwardly bent in a generally L shape with a ridgeline at the bend. However, at this stage, the leg of the element blank is substantially rectangular in cross section, which yet falls far short of a smooth arcuate surface.

Figure 3:
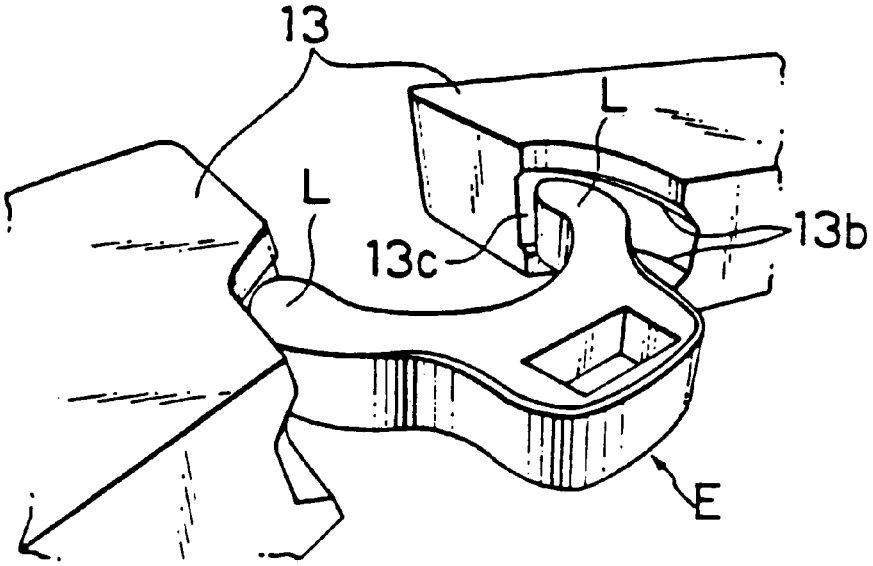
FIG. 3 is a plan view showing a fastener element with its opposite legs ready to be calked.
Figure 4:
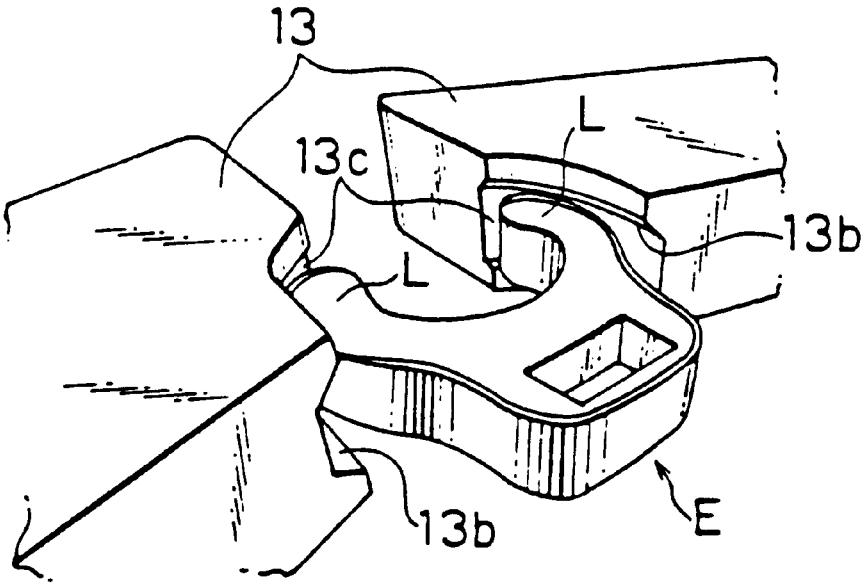
FIG. 4 is a plan view showing the manner in which the opposite legs of the fastener element are calked.
Figure 5:
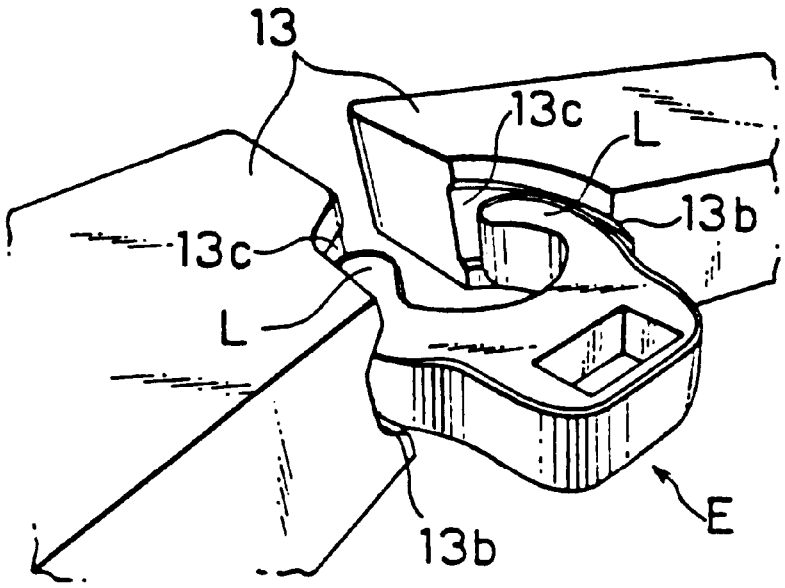
FIG. 5 is a plan view showing the manner in which the fastener element is deformed during the calking.
Figure 6:
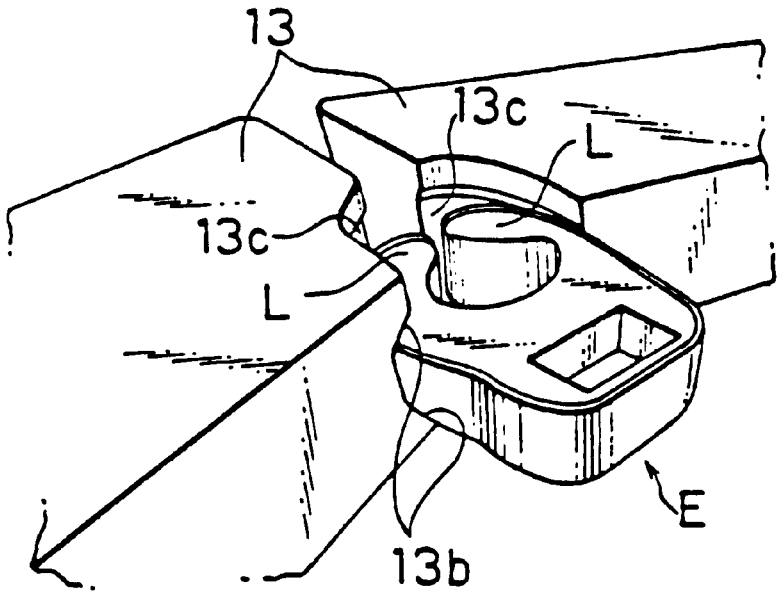
FIG. 6 is a plan view showing the fastener element upon completion of calking.

Subsequently, as the first ram 2 stops retracting, the forming punch 8 and the pressure pad 9 are lowered in cooperation to form a protuberance on the coupling head. At that time, the Talking punch 13 also is stopped, supporting the opposite legs L of the fastener element E from opposite sides, as shown in FIG. 3. When the first ram 2 starts moving forwardly, the calking punch 13 is operated to calk the, opposite legs L of the fastener element E progressively as shown in FIGS. 3 through 6, mounting the fastener element E on the fastener tape T. During this calking, the outer cut edges of tile attaching leg L is deformed into a smooth arcuate surface as the leg L is pressed progressively from its end to base by the arcuate taper surfaces 13*b* of the groove-shape calking surface 13*a* of the calking punch 13, as shown in FIGS. 3 through 6. At the same time, the profiles of the opposite legs L are pressed toward each other by the arcuate bottom surface 13*c* of the calking surface 13*a* to be deformed, completing the mounting of the fastener element E as shown in FIG. 12. Then the procedure goes back to the above-mentioned stage.

In the fastener element E mounted on the fastener tape T, as is apparent from FIG. 12, at least the cut edges of the attaching legs L are shaped into an entirely smooth arcuate profile. Accordingly, the resulting slide fastener gives not only an excellent touch but also a low frictional resistance with a slider so that the slide fastener can be closed and opened smoothly.

As is understood from the foregoing description, according to this invention, the wire W Is rolled into a generally Y shape in cross section and, at the same time, the attaching legs are formed into a generally C shape having a smooth arcuate surface rather than the conventional generally L shape having a ridgeline, whereupon the coupling head of the individual element blank E obtained by cutting the wire W into slices of element blanks E having a predetermined thickness is provided with a protuberance by pressing. Therefore this invention is particularly advantageous to improve the rate of production. Further, since the cut edges of the legs L, which are initially generally right-angled in cross section , are shaped into a smooth arcuate profile as pressed by the calking punch 13 when the generally C-shape legs L of the element blank E are calked on front and back sides of the fastener tape T for mounting the fastener elements E, the entire surfaces of the fastener elements E mounted on the fastener tape are free from any harsh touch, not only giving a neat appearance but also guaranteeing a very smooth movement of the slider.

What is claimed is:

1. A method for forming a row of slide fastener elements, comprising the steps of:

(a) rolling a wire into a generally Y shape in cross section;

(b) cutting the rolled wire transversely into slices of element blanks of a predetermined thickness, each slice of the element blanks having a coupling head and a pair of attaching legs;

(c) forming a protuberance on the coupling head of each of the element blanks;

(d) mounting the element blanks with the protuberances on the coupling heads successively on a fastener tape at predetermined positions;

(e) providing the legs of each slide fastener element with a substantially arcuate profile during the rolling step; and (f) providing at least cut edges of the legs with smooth beveled surfaces during the mounting step.

2. The method of claim 1 wherein the rolling step (a) comprises the step of intermittently supplying the wire at a predetermined pitch.

3. The method of claim 1 wherein the mounting step (d) comprises the step of calking the attaching legs of each of the element blanks on front and back sides of the fastener tape.

4. The method of claim 1 further comprising the step of beveling the entire outer edges of the element blanks.

5. The method of claim 4 further comprising the step of forming each attaching leg to have a smooth continuous arcuate outer surface continuous with a smooth continuous arcuate inner surface.

6. The method of claim 1 further comprising the step of forming each attaching leg to have a smooth continuous arcuate outer surface continuous with a smooth continuous arcuate inner surface.

* * * * *